US010809639B2

(12) United States Patent
Yamawaki et al.

(10) Patent No.: US 10,809,639 B2
(45) Date of Patent: Oct. 20, 2020

(54) TONER

(71) Applicant: CANON KABUSHIKI KAISHA, Tokyo (JP)

(72) Inventors: Kentaro Yamawaki, Mishima (JP); Satoshi Otsuji, Yokohama (JP); Masamichi Sato, Mishima (JP); Hidekazu Fumita, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/670,352

(22) Filed: Oct. 31, 2019

(65) Prior Publication Data

US 2020/0142329 A1 May 7, 2020

(30) Foreign Application Priority Data

Nov. 7, 2018 (JP) ..... 2018-209766

(51) Int. Cl.
*G03G 9/08* (2006.01)
*G03G 9/087* (2006.01)
*G03G 9/083* (2006.01)

(52) U.S. Cl.
CPC ..... *G03G 9/08782* (2013.01); *G03G 9/0832* (2013.01); *G03G 9/08711* (2013.01)

(58) Field of Classification Search
CPC ..... G03G 9/08782; G03G 9/08711
USPC ..... 430/108.4
See application file for complete search history.

(56) References Cited

U.S. PATENT DOCUMENTS 9,170,509 B2 10/2015 Masuda
9,341,967 B2 5/2016 Tsujino et al.
9,366,981 B2 6/2016 Yamawaki et al.
10,429,757 B2 10/2019 Yoshida et al.
10,503,090 B2 12/2019 Tominaga et al.
10,545,422 B2 1/2020 Yamawaki et al.
2013/0280649 A1 10/2013 Nagasawa et al.
2013/0280650 A1 10/2013 Sugama et al.
2014/0205944 A1 7/2014 Masuda
2020/0026208 A1 1/2020 Terui et al.
2020/0026209 A1 1/2020 Yagi et al.

FOREIGN PATENT DOCUMENTS

JP 2002-287410 10/2002
JP 2017-045036 3/2017
WO 2013/047296 4/2013

OTHER PUBLICATIONS

U.S. Appl. No. 16/600,673, Shohei Kototani, filed Oct. 14, 2019.
U.S. Appl. No. 16/600,790, Masatake Tanaka, filed Oct. 14, 2019.
U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,101, Taiji Katsura, filed Dec. 27, 2019.
U.S. Appl. No. 16/728,122, Masamichi Sato, filed Dec. 27, 2019.
U.S. Appl. No. 16/728,151, Mastake Tanaka, filed Dec. 27, 2019.
U.S. Appl. No. 16/728,157, Shohei Kototani, filed Dec. 27, 2019.

*Primary Examiner* — Mark A Chapman
(74) *Attorney, Agent, or Firm* — Venable LLP

(57) ABSTRACT

A toner having a toner particle including a binder resin and a wax, wherein the wax includes a specific diester compound; a proportion As of an area occupied by the wax in a region from a surface of the toner particle to 0.5 μm is 15.0% or less; wax domains are observed in the cross section of the toner particle, and an average number of the domains per cross section of one toner particle is from 10 to 2000; when a mass concentration of a polyvalent metal element in the toner particle determined by fluorescent X-ray analysis is denoted by Mi (ppm), Mi is from 3.5 ppm to 1100 ppm; and when a mass concentration of a polyvalent metal element in the toner particle determined by X-ray photoelectron spectroscopy is denoted by Ms (ppm), $Mi > Ms$.

5 Claims, No Drawings

TONER

BACKGROUND OF THE INVENTION

Field of the Invention

The present invention relates to a toner for use in an image forming method using an electrophotographic system or an electrostatic printing system.

Description of the Related Art

A method, such as electrophotography, for visualizing image information through an electrostatic latent image is currently used in various fields, and improvement in performance of this method such as improvement of image quality and energy saving is needed. In the electrophotographic method, first, an electrostatic latent image is formed on an electrophotographic photosensitive member (image bearing member) by charging and exposure steps. Next, the electrostatic latent image is developed with a developer including a toner, and a visualized image (fixed image) is obtained through a transfer step and a fixing step.

Among these steps, the fixing step requires a relatively large amount of energy, and the development of systems and materials that achieve both energy saving and high image quality is an important technical problem. As an approach from the material standpoint, WO 2013/047296 discloses a technique for including a specific diester compound as a softening agent. The diester compound is a material that can improve the low-temperature fixing performance by being compatible with the binder resin at the time of fixing and plasticizing the binder resin, and greatly contributes to energy saving required in electrophotography.

Meanwhile, the diester compound has problems associated with hot offset and mottling of the fixed image which are due to the strong plasticizing effect thereof. In general, the hot offset is improved by a technique using crosslinking as disclosed in WO 2013/047296 and Japanese Patent Application Publication No. 2017-45036.

SUMMARY OF THE INVENTION

Low-temperature fixability and hot offset resistance can both be achieved by the technique using crosslinking. Although mottling also tends to be improved, it has been found that the binder resin cannot be sufficiently melted by crosslinking, and the gloss of the fixed image, which is important in terms of image quality, is reduced. For this reason, in electrophotography where high image quality is needed, there is a demand for a toner that is excellent in gloss and resistance to mottling of a fixed image while achieving both low-temperature fixability and hot offset resistance while including a diester compound as a softening agent.

An object of the present invention is to provide a toner that ensures excellent image quality such as gloss and resistance to mottling of a fixed image while achieving both low-temperature fixability and hot offset resistance.

The present invention provides a toner having a toner particle including a binder resin and a wax, wherein the wax includes at least one selected from the group consisting of diester compounds represented by following formulas (1) and (2);

when a proportion of an area occupied by the wax in a region from a surface of the toner particle to 0.5 μm in cross-sectional observation of the toner using a transmission electron microscope is denoted by As, As is 15.0% or less;

wax domains are observed in the cross section of the toner particle in cross-sectional observation of the toner using a transmission electron microscope, and an average number of the domains per cross section of one toner particle is from 10 to 2000;

when a mass concentration of a polyvalent metal element in the toner particle determined by fluorescent X-ray analysis is denoted by Mi (ppm), Mi is from 3.5 ppm to 1100 ppm; and when a mass concentration of a polyvalent metal element in the toner particle determined by X-ray photoelectron spectroscopy is denoted by Ms (ppm), the following expression:

$$Mi > Ms$$

is satisfied.

(1)

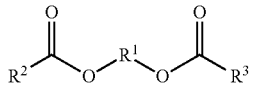

(2)

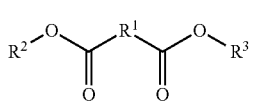

In the formulas (1) and (2), $R^1$ represents an alkylene group having from 1 to 6 carbon atoms, and $R^2$ and $R^3$ each independently represent a linear alkyl group having from 11 to 25 carbon atoms.

According to the present invention, it is possible to provide a toner that ensures excellent image quality such as gloss and resistance to mottling of a fixed image while achieving both low-temperature fixability and hot offset resistance.

Further features of the present invention will become apparent from the following description of exemplary embodiments.

DESCRIPTION OF THE EMBODIMENTS

In the present invention, "from XX to YY" or "XX to YY" representing a numerical range means a numerical range including a lower limit and an upper limit as end points unless otherwise specified.

In order to solve the above-mentioned problems, the inventors of the present invention have examined characteristics required for a toner. First, hot offset resistance is required before the toner and the fixing roller are separated in the fixing step. Therefore, as described in relation to the background art, it is important to impart the toner with a characteristic such as attained when a crosslinking agent is added to promote separation of the toner and the fixing roller.

Next, after fixing, it is necessary that the melted toner have a high leveling property and that the image surface be smoothed to obtain a high-quality fixed image having high gloss. Therefore, the characteristic required of the toner is exactly opposite to that before fixing, and it is important to impart the toner with a characteristic such as attained when a crosslinking agent is not added to lower the melt viscosity of the toner.

That is, it is necessary that before passing through the fixing roller, a toner exhibit a characteristic such as attained when a crosslinking agent is added, and after passing through the fixing roller, the same toner exhibit a characteristic such as attained when a crosslinking agent is not added. Thus, the toner needs to have such contradictory characteristics, but since heat and pressure are applied in the fixing step, it was considered that the problem could be solved by a technique that can control the crosslinked state by using the heat and pressure. An embodiment therefor is described hereinbelow.

The toner of the present invention has a toner particle including a binder resin and a wax, wherein the wax includes at least one selected from the group consisting of diester compounds represented by the following formulas (1) and (2).

(1)

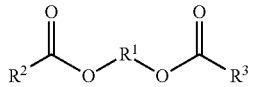

(2)

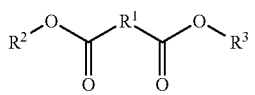

(In the formulas (1) and (2), $R^1$ represents an alkylene group having from 1 to 6 carbon atoms, and $R^2$ and $R^3$ each independently represent a linear alkyl group having from 11 to 25 carbon atoms).

Here, the binder resin is not particularly limited and will be described in detail hereinbelow. The wax includes at least one selected from the group consisting of diester compounds represented by the formulas (1) and (2). In general, ester waxes have high plasticity with respect to a binder resin and are used as a softening agent. In particular, since the diester compound can be compatible with the binder resin in a large amount, the diester compound has a great effect on low-temperature fixability and also has an effect of lowering the melt viscosity when melted.

Since lowering the melt viscosity facilitates leveling, it is advantageous for improving the gloss of fixed images. In the formula (1), $R^1$ is preferably an alkyl group having 1 to 4 carbon atoms, more preferably an ethylene group ($—CH_2—CH_2—$) or a trimethylene group ($—CH_2—CH_2—CH_2—$), and even more preferably an ethylene group.

$R^2$ and $R^3$ represent a linear alkyl group having 11 to 25 carbon atoms, and these $R^2$ and $R^3$ are independent of each other. Therefore, $R^2$ and $R^3$ may be the same group or different groups. From the viewpoint of obtaining a toner excellent in low-temperature fixability (low fixing minimum temperature), $R^2$ and $R^3$ are preferably a straight-chain alkyl group having 13 to 21 carbon atoms, and more preferably a straight-chain alkyl group having 15 to 19 carbon atoms.

Specific examples of the diester compounds represented by the formulas (1) and (2) include ethylene glycol distearate ($R^1=—C_2H_4—$, $R^2=R^3=—C_{17}H_{35}$), distearyl succinate ($R^1=—C_2H_4—$, $R^2=R^3=—C_{18}H_{38}$), trimethylene glycol distearate ($R^1=—C_3H_6—$, $R^2=R^3=—C_{17}H_{35}$), ethylene glycol arachidinate stearate ($R^1=—C_2H_4—$, $R^2=—C_{19}H_{39}$, $R^3=—C_{17}H_{35}$), trimethylene glycol arachidinate stearate ($R^1=—C_3H_6—$, $R^2=—C_{19}H_{39}$, $R^3=—C_{17}H_{35}$), ethylene glycol stearate palmitate ($R^1=—C_2H_4—$, $R^2=—C_{17}H_{35}$, $R^3=—C_{15}H_{31}$), trimethylene glycol stearate palmitate ($R^1=—C_3H_6—$, $R^2=—C_{17}H_{35}$, $R^3=—C_{15}H_{31}$), ethylene glycol dimyristate ($R^1=—C_2H_4—$, $R^2=R^3=—C_{13}H_{27}$), trimethylene glycol dimyristate ($R^1=—C_3H_6—$, $R^2=R^3=—C_{13}H_{27}$), ethylene glycol dipentadecanate ($R^1=—C_2H_4—$, $R^2=R^3=—C_{14}H_{29}$), trimethylene glycol dipentadecanate ($R^1=—C_3H_6—$, $R^2=R^3=—C_{14}H_{29}$), ethylene glycol dipalmitate ($R^1=—C_2H_4—$, $R^2=R^3=—C_{15}H_{31}$), trimethylene glycol dipalmitate ($R^1=—C_3H_6—$, $R^2=R^3=—C_{15}H_{31}$), ethylene glycol dimargarate ($R^1=C_2H_4—$, $R^2=R^3=—C_{16}H_{33}$), trimethylene glycol dimargarate ($R^1=—C_3H_6—$, $R^2=R^3=—C_{16}H_{33}$), ethylene glycol dinonadecanate ($R^1=—C_2H_4—$, $R^2=R^3=—C_{18}H_{37}$), trimethylene glycol dinonadecanate ($R^1=—C_3H_6—$, $R^2=R^3=—C_{18}H_{37}$), ethylene glycol diarachidinate ($R^1=—C_2H_4—$, $R^2=R^3=—C_{19}H_{39}$), trimethylene glycol diarachidinate ($R^1=—C_3H_6—$, $R^2=R^3=—C_{19}H_{39}$), ethylene glycol dibehenate ($R^1=—C_2H_4—$, $R^2=R^3=—C_{21}H_{43}$), and trimethylene glycol dibehenate ($R^1=—C_3H_6—$, $R^2=R^3=—C_{21}H_{43}$).

Among these diester compounds, ethylene glycol distearate, distearyl succinate, and trimethylene glycol distearate are more preferable.

The diester compound preferably has a number average molecular weight (Mn) of an o-dichlorobenzene soluble fraction from 500 to 1000 as measured by high-temperature gel permeation chromatography (GPC). When the number average molecular weight (Mn) is 500 or more, the migration of wax to the toner particle surface is reduced, and the development durability is further improved. Further, when the number average molecular weight is 1000 or less, the plasticity with respect to the binder resin is high, and low temperature fixability is further improved. More preferably, the number average molecular weight is from 550 to 850.

The amount of the diester compound is preferably 1 part by mass to 25 parts by mass with respect to 100 parts by mass of the binder resin. When the amount is 1 part by mass or more, the low-temperature fixability is satisfactory. Meanwhile, when the amount is 25 parts by mass or less, the storage stability is improved.

The amount of wax is preferably 4 parts by mass to 35 parts by mass with respect to 100 parts by mass of the binder resin.

Examples of methods for producing the diester compound include a synthesis method by oxidation reaction, synthesis from carboxylic acid and a derivative thereof, an ester group introduction reaction represented by Michael addition reaction, a method using a dehydration condensation reaction from a carboxylic acid compound and an alcohol compound, a reaction from an acid halide and an alcohol compound, and a transesterification reaction. A catalyst can also be used as appropriate.

The catalyst is preferably a general acidic or alkaline catalyst used in the esterification reaction, for example, zinc acetate, a titanium compound and the like. After the esterification reaction, the target product may be purified by recrystallization, distillation or the like. A typical production example is presented hereinbelow. A method for producing the diester compound to be used in the present invention is not limited to the following method.

First, an alcohol and a carboxylic acid as starting materials are added to a reaction vessel. For example, the alcohol and the carboxylic acid are mixed so that a molar ratio of alcohol:carboxylic acid=1:2 or alcohol:carboxylic acid=2:1. The ratio may be changed in consideration of reactivity in the dehydration condensation reaction or the like.

Next, the mixture is heated, as appropriate, to perform a dehydration condensation reaction. A basic aqueous solution and an appropriate organic solvent are added to the esterified crude product obtained by the dehydration condensation reaction, and the unreacted alcohol and carboxylic acid are deprotonated and separated into an aqueous phase. Thereafter, a diester compound is obtained by appropriately washing with water, distilling off the solvent, and filtering.

The wax may include only the diester compound, but may also include other ester compounds as necessary. For example, the following ester compounds can be exemplified.

An ester of a monohydric alcohol and an aliphatic carboxylic acid such as behenyl behenate, stearyl stearate, and palmityl palmitate, or an ester of a monovalent carboxylic acid and an aliphatic alcohol; an ester of a dihydric alcohol and an aliphatic carboxylic acid such as dibehenyl sebacate, or an ester of a divalent carboxylic acid and an aliphatic alcohol; an ester of a trihydric alcohol and an aliphatic carboxylic acid such as glycerol tribehenate, or an ester of a trivalent carboxylic acid and an aliphatic alcohol; an ester of a tetrahydric alcohol and an aliphatic carboxylic acid such as pentaerythritol tetrastearate and pentaerythritol tetrapalmitate, or an ester of a tetravalent carboxylic acid and an aliphatic alcohol; an ester of a hexahydric alcohol and an aliphatic carboxylic acid such as dipentaerythritol hexastearate or dipentaerythritol hexapalmitate, or an ester of a hexavalent carboxylic acid and an aliphatic alcohol; an ester of a polyhydric alcohol and an aliphatic carboxylic acid such as polyglycerol behenate, or an ester of a polyvalent carboxylic acid and an aliphatic alcohol; and a natural ester wax such as carnauba wax and rice wax.

Furthermore, the wax may include a wax that suitably acts as a release agent. Such waxes include petroleum waxes such as paraffin wax, microcrystalline wax, petrolatum and derivatives thereof; montan wax and derivatives thereof; hydrocarbon waxes obtained by a Fischer-Tropsch method, and derivatives thereof; polyolefin waxes such as polyethylene wax and polypropylene wax, and derivatives thereof, natural waxes such as carnauba wax and candelilla wax, and derivatives thereof, higher aliphatic alcohols; fatty acids such as stearic acid, palmitic acid and the like; acid amide waxes; hardened castor oil and derivatives thereof; plant waxes; animal waxes; and the like.

Of these, paraffin waxes and hydrocarbon waxes are particularly preferable from the viewpoint of excellent releasability.

Further, when the proportion of an area occupied by the wax in a region from a surface of the toner particle to 0.5 μm in cross-sectional observation of the toner using a transmission electron microscope is denoted by As, As is 15.0% or less.

Furthermore, wax domains are observed in the cross section of the toner particle in cross-sectional observation of the toner using a transmission electron microscope, and the average number of the domains per cross section of one toner particle is from 10 to 2000.

As being 15.0% or less indicates that a large amount of wax is present inside the toner particle. As is preferably 12.0% or less. Meanwhile, the lower limit is not particularly limited, but is preferably 0.5% or more, and more preferably 3.0% or more.

Further, the average number of domains being from 10 to 2000 indicates that the wax is present in a finely dispersed state. The average number of domains is preferably from 20 to 1500.

Both As and the average number of domains being in the above ranges indicates that the wax is present in a finely dispersed state inside the toner particle.

Since the diester compound is a substance for compatibilizing the binder resin, it is preferable that the diester compound be finely dispersed in the binder resin inside the toner particle because the low-temperature fixability can be further improved. Moreover, fine dispersion of the diester compound inside the resin is also preferable in terms of forming a crosslinked structure by interaction with a polyvalent metal element described hereinbelow.

The position and state in which the wax is present can be controlled by, for example, conditions at which the wax once melted in the binder resin is thereafter cooled, or inclusion of a polyvalent metal element described hereinbelow.

The cooling conditions can be determined by a cooling start temperature, a cooling rate, a cooling end temperature, and the like, and the cooling start temperature is preferably any temperature higher than the crystallization temperature of the wax in the binder resin. When the cooling start temperature is within this range, fine crystal nuclei of the wax are generated by cooling, and wax domains grow using this as nuclei, so that the generation of fine domains is promoted.

The cooling rate is preferably from 0.33° C./sec to 13.00° C./sec. When the cooling rate is within this range, the binder resin is cured sufficiently rapidly with cooling, so that oriented growth of crystals is inhibited and nearly spherical domains are formed even in the wax that easily forms plate crystal. Meanwhile, when the cooling rate is too high, the heat shrinkage speed varies depending on the combination of materials in the toner, and distortion may occur. Therefore, the cooling rate is preferably 13.00° C./sec or less.

The cooling end temperature is preferably less than the glass transition temperature (Tg) of the binder resin. When the cooling end temperature is within this range, the growth of the wax domain can be suppressed by the curing of the binder resin. The presence state of the wax domains can be confirmed by observing the cross section of the toner particle with a transmission electron microscope.

When the average number of wax domains observed in the cross section of one toner particle is 10 or more, the speed of plasticization of the wax into the binder resin at the time of fixing is sufficient. When the average number is 2000 or less, it is possible to prevent a decrease in heat-resistant storage stability caused by an increase in the amount of wax that remains compatible due to excessive fine dispersion.

Further, it is preferable that the average major axis, which is the average value of the largest diameters of the wax domains, be from 0.03 μm to 1.00 μm. When the average major axis is 0.03 μm or more, it is possible to prevent a decrease in in heat-resistant storage stability caused by formation of excessively small domains, and when the average major axis is 1.00 μm or less, the exposure of the wax to the toner particle surface which is caused by the increase in the amount of domains located close to the toner particle surface is suppressed.

Further, when the average value of the smallest diameters of the wax domains is defined as the average minor axis, the (average major axis)/(average minor axis) value is preferably 1.0 or more and smaller than 3.0. When the (average major axis)/(average minor axis) value is smaller than 3.0, it means that the wax domains are not plate-shaped. Therefore, it is possible to prevent the wax from being exposed to the toner particle surface due to crystal growth caused by the wax-compatible component in the binder resin being oriented in the domain over time.

Furthermore, in the present invention, when the mass concentration of a polyvalent metal element in the toner particle determined by fluorescent X-ray analysis is denoted by Mi (ppm), it is necessary that Mi be from 3.5 ppm to 1100 ppm. Further, when the mass concentration of a polyvalent metal element in the toner particle determined by X-ray photoelectron spectroscopy is denoted by Ms (ppm), Mi>Ms. Preferably, 15.0<Mi−Ms<900.

Here, the "polyvalent metal element" in the present invention is a metal element that generates a polyvalent metal ion.

In fluorescent X-ray analysis, a sample is irradiated with continuous X-rays to generate characteristic X-rays (fluorescent X-rays) unique to the elements constituting the sample. The generated fluorescent X-ray is spectrally separated (spectral dispersion type) with a spectral crystal to generate a spectrum, the obtained spectrum is measured, and the constituent elements are quantitatively analyzed from the measured intensity. In the fluorescent X-ray analysis, when the measurement object is a resin, the measurement can be performed up to a depth of several millimeters, so that the amount of the polyvalent metal element in the entire toner can be measured.

Meanwhile, in X-ray photoelectron spectroscopic analysis, the measurement can be performed up to a depth of several nanometers, so that the amount of the polyvalent metal element on the toner particle surface can be measured.

That is, Mi>Ms represents that there are more polyvalent metal elements inside than on the surface of the toner particle. It has been found that by satisfying this condition and the aforementioned position and state in which the wax is present, a fixed image having satisfactory hot offset resistance and excellent image quality such as gloss and resistance to mottling can be obtained. The following mechanism thereof is presumed.

First, the toner before fixing has the aforementioned configuration, whereby a polyvalent metal and a diester compound form a metal carbonyl to form a loose crosslinked structure such as a so-called metal crosslink. That is, the toner particle preferably has a metal carbonyl structure formed of a diester compound and a polyvalent metal element. When such toner is subjected to heat and pressure at the fixing roller, since the metal carbonyl is contained in a larger amount inside the toner particle, the toner particle is not instantly plasticized due to the loose crosslinked structure thereof, and the separation between the fixing roller and the toner is satisfactory. Thereafter, the metal carbonyl bonds are broken under the effect of heat and pressure, so that the crosslinked structure collapses, the entire toner is plasticized, and the image surface is smoothed.

In other words, by controlling the crosslinked state by using the heat and pressure received in the fixing step, it is possible to impart a single toner with mutually contradictory characteristics, namely, before passing through the fixing roller, a characteristic such as attained when a crosslinking agent is added, and after passing through the fixing roller, a characteristic such as attained when a crosslinking agent is not added. It is presumed that the above mechanism makes it possible to realize low-temperature fixability, hot offset resistance, and high-quality fixed images in one toner.

Satisfactory hot offset resistance can be obtained when Mi is 3.5 ppm or more. Meanwhile, when the Mi is 1100 ppm or less, satisfactory low-temperature fixability is maintained. Mi is preferably from 10.0 ppm to 800.0 ppm.

Meanwhile, Ms is preferably from 5.0 ppm to 200.0 ppm. Mi and Ms can be controlled by the addition timing and amount added of the polyvalent metal compound during toner production.

In addition, when two or more kinds of polyvalent metal elements are included, the mass concentration range is a total value of the respective polyvalent metal elements.

The binder resin preferably has a carboxy group. The polyvalent metal element is preferably at least one selected from the group consisting of iron, aluminum, copper, zinc, magnesium, and calcium.

In this case, the low-temperature fixability and the hot offset resistance are further improved. This is presumably because a combination of a binder resin having a carboxy group and a metal having a high complex stability coefficient results in bridging of the binder resin and the wax through the metal. As a result, the occurrence of instant plasticization is further suppressed when heat and pressure are applied during fixing. In addition, since the binder resin and the wax are bridged when plasticization occurs, it is considered that the low-temperature fixability is extended by efficiently plasticizing the binder resin.

Of these polyvalent metals, the following are more preferable.

The polyvalent metal element is aluminum, and the Net intensity based on aluminum measured by fluorescent X-ray analysis is from 0.10 kcps to 0.50 kcps (more preferably from 0.2 kcps to 0.4 kcps);

the polyvalent metal element is iron, and the Net intensity based on iron measured by fluorescent X-ray analysis is from 1.00 kcps to 5.00 kcps (more preferably from 2.00 kcps to 4.00 kcps); and the polyvalent metal element is magnesium or calcium, and the total Net intensity based on magnesium or calcium measured by fluorescent X-ray analysis is from 3.00 kcps to 20.00 kcps (more preferably from 4.00 kcps to 18.00 kcps).

The Net intensity refers to the X-ray intensity obtained by subtracting the background intensity from the X-ray intensity at the peak angle indicating the presence of a metal element. When these specific polyvalent metals and amounts are used, in particular, the low-temperature fixability and hot offset resistance are satisfactory. Since these metals are relatively easily ionized, it is considered that metal bridges are easily formed.

Moreover, it is considered that the fact that the preferable range of the Net intensity varies depending on the substance is related to the valence of the metal. In other words, when the valence is high, crosslinking can be achieved with a small amount of metal. Therefore, the amount of trivalent aluminum may be small, the amount of divalent magnesium and calcium needs to be large, and the amount of iron that can have a mixed valence may be therebetween.

A means for including a polyvalent metal element in the toner particle is not particularly limited. For example, when the toner particles are produced by a pulverization method, a method in which a polyvalent metal element is included in the raw material resin in advance, or a method in which a polyvalent metal element is added and included when the raw material is melted and kneaded can be used. In the case of producing toner particles by a wet production method such as a polymerization method, a method of including a polyvalent metal element in a raw material or a method of adding via an aqueous medium in the production process can be used. In the wet production method, from the viewpoint of uniformity it is preferable that a polyvalent metal element be included in the toner particle after being ionized in an aqueous medium. For example, in the emulsion aggregation method, a polyvalent metal element can be included as a flocculant in the toner particle.

A form of the polyvalent metal element when mixing at the time of production is not particularly limited. The metal can be used as it is, or can be also used in the form of chloride, halide, hydroxide, oxide, sulfide, carbonate, sulfate, hexafluorosilylate, acetate, thiosulfate, phosphate, hydrochloric acid salts, nitric acid salts and the like. As described above, it is preferable that these be included in the toner particle after being ionized in an aqueous medium.

An aqueous medium refers to a medium including 50% by mass or more of water and 50% by mass or less of a water-soluble organic solvent. Examples of the water-soluble organic solvent include methanol, ethanol, isopropanol, butanol, acetone, methyl ethyl ketone, and tetrahydrofuran.

When a toner is produced in an aqueous medium including hydroxyapatite, and calcium is used as the polyvalent metal element, attention should be paid to the amount added.

The chemical formula of hydroxyapatite is $Ca_{10}(PO_4)_6(OH)_2$, and the ratio of the number of moles of calcium and phosphorus is 1.67. Therefore, when the number of moles of calcium is M(Ca) and the number of moles of phosphorus is M(P), calcium is taken into hydroxyapatite under the condition of M (Ca)≤1.67M (P). Therefore, unless calcium exceeding this amount is present in the system, calcium is unlikely to be taken into the toner.

For the same reason, when a toner is produced in an aqueous medium including magnesium hydroxide, and magnesium is used as the polyvalent metal element, attention should be paid to the amount added. Since magnesium hydroxide is $Mg(OH)_2$, when preparing magnesium hydroxide, it is necessary to add magnesium in the number of moles exceeding ½ with respect to sodium hydroxide.

Binder Resin

The binder resin is not particularly limited, and preferred examples include vinyl resins and polyester resins. Examples of vinyl resins, polyester resins, and other binder resins include the following resins or polymers.

Homopolymer of styrene and substituents thereof, such as polystyrene and polyvinyltoluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resin, polyamide resin, epoxy resin, polyacrylic resin, rosin, modified rosin, terpene resin, phenol resin, aliphatic or alicyclic hydrocarbon resin, and aromatic petroleum resin. These binder resins can be used alone or in combination.

The binder resin preferably includes a carboxy group, and more preferably is a vinyl resin having a carboxy group.

The binder resin having a carboxy group can be produced, for example, by combining a polymerizable monomer including a carboxy group with a polymerizable monomer that produces a desired binder resin.

The polymerizable monomer including a carboxy group can be exemplified by vinyl carboxylic acids such as acrylic acid, methacrylic acid, α-ethylacrylic acid and crotonic acid; unsaturated dicarboxylic acids such as fumaric acid, maleic acid, citraconic acid and itaconic acid; unsaturated dicarboxylic acid monoester derivatives such as succinic acid monoacryloyloxyethyl ester, succinic acid monoacryloyloxyethylene ester, phthalic acid monoacryloyloxyethyl ester, and phthalic acid monomethacryloyloxyethyl ester; and the like.

For the vinyl resin, for example, the following monomers can be used.

Styrene monomers such styrene and derivatives thereof, for example, styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecyl styrene.

Acrylic acid esters such as methyl acrylate, ethyl acrylate, n-butyl acrylate, isopropyl acrylate, propyl acrylate, n-octyl acrylate, dodecyl acrylate, 2-ethylhexyl acrylate, stearyl acrylate, 2-chloroethyl acrylate, and phenyl acrylate.

Methacrylic acid esters such as ca-methylene aliphatic monocarboxylic acid esters, for example, methyl methacrylate, ethyl methacrylate, propyl methacrylate, n-butyl methacrylate, isobutyl methacrylate n-octyl, methacrylate, dodecyl methacrylate, 2-ethylhexyl methacrylate, stearyl methacrylate, phenyl methacrylate, dimethylaminoethyl methacrylate, and diethylaminoethyl methacrylate.

Among these, a polymer of styrene with at least one selected from the group consisting of acrylic acid esters and methacrylic acid esters is preferable.

As the polyester resin, those obtained by polycondensation of the following carboxylic acid component and alcohol component can be used. Examples of the carboxylic acid component include terephthalic acid, isophthalic acid, phthalic acid, fumaric acid, maleic acid, cyclohexanedicarboxylic acid, and trimellitic acid.

Examples of the alcohol component include bisphenol A, hydrogenated bisphenol, bisphenol A ethylene oxide adduct, bisphenol A propylene oxide adduct, glycerin, trimethylolpropane, and pentaerythritol.

Further, the polyester resin may be a polyester resin including a urea group. A polyester resin in which a carboxy group such as an end group is not capped is preferable.

The binder resin may have a polymerizable functional group for the purpose of improving the viscosity change of the toner at high temperature. Examples of the polymerizable functional group include a vinyl group, an isocyanate group, an epoxy group, an amino group, a carboxy group, and a hydroxy group.

Crosslinking Agent

In order to control the molecular weight of the binder resin constituting the toner particle, a crosslinking agent may be added during the polymerization of the polymerizable monomer.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylate of polyethylene glycols #200, #400, and #600, dipropylene glycol diacrylate, polypropylene glycol diacrylate, polyester diacrylate (MANDA, Nippon Kayaku Co., Ltd.), and above compounds in which acrylate is changed to methacrylate.

The addition amount of the crosslinking agent is preferably from 0.001 part by mass to 15.000 parts by mass with respect to 100 parts by mass of the polymerizable monomer.

Colorant

The toner particles may include a colorant. The colorant is not particularly limited, and well-known colorants shown below can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180.

Examples of orange pigments are presented below.

Permanent Orange GTR, Pyrazolone Orange, Vulcan Orange, Benzidine Orange G, Indanthrene Brilliant Orange RK, and Indathrene Brilliant Orange GK.

Examples of red pigments include Indian Red, condensed azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, and perylene compounds. Specific examples are presented hereinbelow.

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial chloride of Phthalocyanine Blue, Fast Sky Blue, Indathrene Blue BG and the like, anthraquinone compounds, basic dye lake compounds and the like. Specific examples are presented hereinbelow.

C. I. Pigment Blue 1, 7, 15, 15:1, 15:2, 15:3, 15:4, 60, 62, 66.

Examples of purple pigments include Fast Violet B and Methyl Violet Lake.

Examples of green pigments include Pigment Green B and Malachite Green Lake. Examples of white pigments include zinc white, titanium oxide, antimony white and zinc sulfide.

Examples of black pigments include carbon black, aniline black, non-magnetic ferrites, magnetite, and those which are colored black by using the abovementioned yellow colorants, red colorants and blue colorants. These colorants can be used singly or in a mixture, or in the form of a solid solution.

If necessary, the colorant may be surface-modified by performing surface treatment with a substance which does not inhibit polymerization.

The amount of the colorant is preferably from 3.0 parts by mass to 20.0 parts by mass with respect to 100.0 parts by mass of the binder resin or the polymerizable monomer that produces the binder resin.

Charge Control Agent

The toner particle may include a charge control agent. As the charge control agent, known charge control agents can be used. In particular, a charge control agent that has a high charging speed and can stably maintain a constant charge amount is preferable. Further, in the case where the toner particle is produced by a direct polymerization method, a charge control agent that has a low polymerization inhibition property and is substantially not solubilized in an aqueous medium is preferable.

Examples of charge control agents that control the toner particle to be negatively chargeable are presented hereinbelow.

Organometallic compounds and chelate compounds exemplified by monoazo metal compounds, acetylacetone metal compounds, and metal compounds based on aromatic hydroxycarboxylic acids, aromatic dicarboxylic acids, hydroxycarboxylic acids and dicarboxylic acids. Other examples include aromatic hydroxycarboxylic acids, aromatic mono- and polycarboxylic acids and metal salts, anhydrides, esters, phenol derivatives, such as bisphenol, thereof and the like. Furthermore, urea derivatives, metal-containing salicylic acid compounds, metal-containing naphthoic acid compounds, boron compounds, quaternary ammonium salts, and calixarenes can be mentioned.

Meanwhile, examples of charge control agents that control the toner particle to be positively chargeable are presented hereinbelow.

Nigrosine and products of nigrosine modification by fatty acid metal salts or the like; guanidine compounds; imidazole compounds; quaternary ammonium salts such as tributylbenzylammonium-1-hydroxy-4-naphthosulfonate and tetrabutyl ammonium tetrafluoroborate, onium salts such as phosphonium salts which are analogues thereof, and lake pigments thereof; triphenylmethane dyes and lake pigments thereof (examples of lake forming agents include phosphotungstic acid, phosphomolybdic acid, phosphotungsten-molybdic acid, tannic acids, lauric acid, gallic acid, ferricyanic acid, ferrocyanide compounds and the like); metal salts of higher aliphatic acids; and resin-based charge control agents.

These charge control agents can be used alone or in combination of two or more. When using a charge control agent including a metal, the amount of the metal may be controlled in the range of the present invention. The addition amount of these charge control agents is preferably from 0.01 parts by mass to 10.00 parts by mass with respect to 100.00 parts by mass of the binder resin.

External Additive

The toner particles may be used as a toner as they are. In order to improve flowability, charging performance, cleaning property, and the like, a fluidizing agent, a cleaning aid or the like, which is the so-called external additive, may be added to the toner particle to obtain the toner.

Examples of the external additive include inorganic oxide fine particles such as silica fine particles, alumina fine particles, and titanium oxide fine particles, inorganic stearic acid compound fine particles such as aluminum stearate fine particles and zinc stearate fine particles, or inorganic titanic acid compound fine particles such as strontium titanate and zinc titanate. These can be used individually by one type or in combination of two or more types.

These inorganic fine particles are preferably subjected to the gloss treatment with a silane coupling agent, a titanium coupling agent, a higher fatty acid, a silicone oil or the like in order to improve heat-resistant storability and environmental stability. The BET specific surface area of the external additive is preferably from 10 $m^2/g$ to 450 $m^2/g$.

The BET specific surface area can be determined by a low-temperature gas adsorption method based on a dynamic constant pressure method according to a BET method (preferably a BET multipoint method). For example, the BET specific surface area ($m^2/g$) can be calculated by adsorbing nitrogen gas on the surface of a sample and performing measurement by the BET multipoint method by using a specific surface area measuring apparatus (trade name: GEMINI 2375 Ver. 5.0, manufactured by Shimadzu Corporation).

The total addition amount of these various external additives is preferably from 0.05 parts by mass to 5 parts by mass, and more preferably from 0.1 parts by mass to 3 parts by mass with respect to 100 parts by mass of the toner particles. Various external additives may be used in combination.

Developer

The toner can be used as a magnetic or non-magnetic one-component developer, but may be mixed with a carrier and used as a two-component developer.

As the carrier, magnetic particles composed of conventionally known materials such as metals such as iron, ferrites, magnetite and alloys of these metals with metals such as aluminum and lead can be used. Among them, ferrite particles are preferable. Further, a coated carrier obtained by coating the surface of magnetic particles with a coating agent such as a resin, a resin dispersion type carrier obtained by dispersing magnetic fine powder in a binder resin, or the like may be used as the carrier.

The volume average particle diameter of the carrier is preferably from 15 μm to 100 μm, and more preferably from 25 μm to 80 μm.

Method for Producing Toner Particles

Known methods can be used for producing the toner particles, and a kneading pulverization method or a wet production method can be used. From the viewpoint of uniform particle diameter and shape controllability, a wet production method can be preferably used. The wet production methods include a suspension polymerization method, a dissolution suspension method, an emulsion polymerization aggregation method, an emulsion aggregation method, and the like, and in the present invention, the emulsion aggregation method is more preferable. This is because (i) it is easy to ionize the polyvalent metal element in the aqueous medium, (ii) the polyvalent metal element is easily included in the toner particle when aggregating the binder resin, and (iii) the diester compound is easily metal-crosslinked.

In the emulsion aggregation method, first, fine particles of the binder resin, wax fine particles, and, if necessary, fine particles of an additive such as a colorant are dispersed and mixed in an aqueous medium including a dispersion stabilizer. A surfactant may be added to the aqueous medium. Thereafter, aggregation is performed until a desired toner particle diameter is obtained by adding a flocculant. Preferably, a salt of the polyvalent metal element is used as the flocculant. Thereafter or simultaneously with the aggregation, the fine particles are fused. When fusing, a metal source such as a salt of a polyvalent metal element may be added. Furthermore, if necessary, toner particles are formed by controlling the shape by heat.

Here, the fine particles of the binder resin may also be composite particles formed of a plurality of layers constituted by two or more layers made of resins having different compositions. For example, the particles can be produced by an emulsion polymerization method, a miniemulsion polymerization method, a phase inversion emulsification method or the like, or can be produced by combining several production methods.

In the case where an internal additive is contained in the toner particles, the internal additive may be included in the resin fine particles, or a dispersion liquid of the internal additive fine particles comprising only the internal additive may be separately prepared, and the internal additive fine particles may be aggregated together with the fine resin particles at the time of aggregation. In addition, by aggregating resin fine particles having different compositions by adding the particles with a difference in time at the time of aggregation, it is also possible to prepare toner particles having a layered configuration including layers of different compositions.

The following dispersion stabilizers can be used.

Examples of inorganic dispersion stabilizers include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Examples of organic dispersion stabilizers include polyvinyl alcohol, gelatin, methylcellulose, methylhydroxypropyl cellulose, ethylcellulose, sodium salt of carboxymethylcellulose, and starch.

As the surfactant, known cationic surfactants, anionic surfactants, and nonionic surfactants can be used. Specific examples of cationic surfactants include dodecyl ammonium bromide, dodecyl trimethyl ammonium bromide, dodecyl pyridinium chloride, dodecyl pyridinium bromide, hexadecyl trimethyl ammonium bromide and the like.

Specific examples of nonionic surfactants include dodecyl polyoxyethylene ether, hexadecyl polyoxyethylene ether, norylphenyl polyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, sodium lauryl sulfate, sodium dodecylbenzenesulfonate, polyoxyethylene (2) sodium lauryl ether sulfate and the like.

From the viewpoint of high definition and high resolution of the image, it is preferable that the toner have a weight average particle diameter of from 3.0 μm to 10.0 μm. The particle diameter of the toner can be measured by the pore electrical resistance method. For example, measurement and calculation can be performed using "Coulter Counter Multisizer 3" and dedicated software "Beckman Coulter Multisizer 3 Version 3.51" (manufactured by Beckman Coulter, Inc.) provided therewith.

Further, from the viewpoint of improving transfer efficiency, the average circularity of the toner is preferably 0.930 to 1.000, and more preferably 0.950 to 0.995. The average circularity of the toner can be measured and calculated using "FPIA-3000" (manufactured by Sysmex Corporation).

Methods for Measuring Physical Properties of Toner

Measurement of Toner Particle Diameter

A precision particle size distribution measuring device (trade name: Coulter Counter Multisizer 3) based on a pore electric resistance method and dedicated software (trade name: Beckman Coulter Multisizer 3, Version 3.51, manufactured by Beckman Coulter, Inc.) are used. The aperture diameter is 100 μm, the measurement is performed with 25,000 effective measurement channels, and the measurement data are analyzed and calculated.

A solution prepared by dissolving special grade sodium chloride in ion exchanged water to a concentration of about 1% by mass, for example, "ISOTON II" (trade name) manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using "standard particles 10.0 μm" (manufactured by Beckman Coulter, Inc.) is set as a Kd value. The threshold and the noise level are automatically set by pressing a measurement button of threshold/noise level. Further, the current is set to 1600 μA, the gain is set to 2, the electrolytic solution is set to ISOTON II (trade name), and flush of aperture tube after measurement is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

The specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) About 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water is added thereto.

(3) A predetermined amount of ion exchanged water and about 2 mL of the CONTAMINON N (trade name) are placed in the water tank of an ultrasonic disperser (trade name: Ultrasonic Dispersion System Tetora 150, manufactured by Nikkaki Bios Co., Ltd.) with an electrical output of 120 W in which two oscillators with an oscillation frequency of 50 kHz are built in with a phase shift of 180 degrees.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner (particles) is dispersed is dropped using a pipette into the round bottom beaker of (1) hereinabove which has been set in the sample stand, and the measurement concentration is adjusted to be about 5%. Then, measurement is conducted until the number of particles to be measured reaches 50000.

(7) The measurement data are analyzed with the dedicated software provided with the apparatus, and the weight average particle diameter (D4) is calculated. The "AVERAGE DIAMETER" on the analysis/volume statistical value (arithmetic mean) screen when the dedicated software is set to graph/volume % is the weight average particle diameter (D4). The "AVERAGE DIAMETER" on the analysis/number statistical value (arithmetic mean) screen when the dedicated software is set to graph/number % is the number average particle diameter (Dl).

Method for Measuring Average Circularity of Toner (Particle)

The average circularity of the toner (particles) is measured using a flow type particle image analyzer "FPIA-3000" (manufactured by Sysmex Corporation) under the measurement and analysis conditions at the time of calibration operation.

A suitable amount of a surfactant and an alkylbenzene sulfonate as a dispersant is added to 20 mL of ion exchanged water, and then 0.02 g of a measurement sample is added. The dispersion treatment is performed for 2 min using a tabletop ultrasonic cleaner disperser (trade name: VS-150, manufactured by VELVO-CLEAR Co.) with an oscillation frequency of 50 kHz and an electrical output of 150 watts to obtain a dispersion solution for measurement. At that time, the dispersion solution is cooled, as appropriate, to a temperature of 10° C. to 40° C.

For the measurement, a flow type particle image analyzer equipped with a standard objective lens (×10) is used, and a particle sheath "PSE-900A" (manufactured by Sysmex Corporation) is used as a sheath liquid. The dispersion solution prepared according to the procedure is measured in the HPF measurement mode for 3000 toner (particles) in a total count mode. The binarization threshold value at the time of particle analysis is set to 85%, the particle diameter to be analyzed is restricted to a circle-equivalent diameter of 1.98 μm to 19.92 μm, and the average circularity of the toner (particles) is obtained.

In the measurement, automatic focusing is performed using standard latex particles (for example, 5100A (trade name) manufactured by Duke Scientific Inc. which are diluted with ion exchanged water) before the start of the measurement. After that, it is preferable to perform focusing every 2 h from the start of the measurement.

Cross-Sectional Observation of Toner Using Transmission Electron Microscope

The cross section of the toner is observed by the following method. The toner is encapsulated in a visible-light-curable encapsulating resin (D-800, manufactured by Nisshin EM Co., Ltd.), and a toner cross section having a thickness of 60 nm is prepared with an ultrasonic ultramicrotome (EM5, Leica Camera AG).

The obtained cross section is stained for 15 min in a $RuO_4$ gas in a 500 Pa atmosphere by using a vacuum electronic staining apparatus (Filgen, Inc., VSC4R1H), and STEM observation is performed using a transmission electron microscope (JEOL, JEM2800). An image of the toner to be observed is captured by selecting at random 10 particles having a diameter within ±2.0 μm from the weight average particle diameter. The obtained image is binarized using image processing software "Image-Pro Plus (Media Cybernetics Inc.)" to clarify the distinction between the wax domains and the binder resin region.

Masking is carried out by leaving a region having a depth of 0.5 μm (including a boundary of 0.5 μm) from the surface (the contour of the cross section) of toner particle in the cross section of the toner particle, the percentage of the area occupied by the wax domains in the area of the remaining region is calculated, and the average value for 10 toner particles is taken as As (%).

Also, the number of wax domains in each of the 10 captured toner particle images is counted, and the average value thereof is taken as the average number of wax domains.

Measurement of Amount of Polyvalent Metal Element by Fluorescent X-ray Analysis

A wavelength-dispersive fluorescent X-ray analyzer "Axios" (manufactured by PANalytical) and dedicated software "SuperQ ver. 4.0F" (manufactured by PANalytical) provided therewith and serving for setting measurement conditions and analyzing measurement data are used. Rh is used as the anode of the X-ray tube, the measurement atmosphere is vacuum, the measurement diameter (collimator mask diameter) is 27 mm, and the measurement time is 10 sec. Further, when measuring a light element, the element is detected by a proportional counter (PC), and when measuring a heavy element, the element is detected by a scintillation counter (SC).

A pellet to be used as a measurement sample is prepared by placing 4 g of toner particles in a dedicated aluminum ring for pressing, leveling the toner, and pressing with a tablet molding compressor "BRE-32" (manufactured by Maekawa Test Instruments Co., Ltd.) for 60 sec under 20 MPa to form a tablet having a thickness of 2 mm and a diameter of 39 mm.

For quantification, a polyvalent metal to be quantified is added to 100 parts by mass of a resin sample, which does not contain a metal element, so as to obtain 5.0 ppm on a mass basis, and sufficient mixing is performed using a coffee mill. Similarly, a resin sample is mixed so that the polyvalent metal to be quantified is contained at 50.0 ppm, 500.0 ppm, and 5000.0 ppm, and these are used as samples for the calibration curve.

For each sample, the pellet of the sample for a calibration curve is prepared as described above using a tablet molding compressor and measured. At this time, the acceleration voltage and current value of the X-ray generator are 24 kV and 100 mA, respectively. A calibration curve in the form of a linear function is obtained by plotting the obtained X-ray count rate on the ordinate and plotting the added amount of the polyvalent metal in each sample for a calibration curve on the abscissa.

Next, the toner particles to be analyzed are pelletized as described above using the tablet molding compressor and measured. Then, the amount of the polyvalent metal element in the toner particle is determined from the above calibration curve.

(Calculation of Net Intensity)

Further, the X-ray intensity obtained by subtracting the background intensity from the X-ray intensity at the peak angle indicating the presence of the metal element which is obtained by the above measurement is defined as the Net intensity.

(Separation of External Additives from Toner)

Toner particles obtained by removing external additives from the toner by the following method are used as samples.

A total of 160 g of sucrose (manufactured by Kishida Chemical Co., Ltd.) is added to 100 mL of ion exchanged water, and dissolved while heating with hot water to prepare a sucrose concentrated solution. A total of 31 g of the sucrose concentrated solution and 6 mL of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube to prepare a dispersion liquid. A total of 1.0 g of the toner is added to the dispersion liquid and the toner lump is loosened with a spatula or the like.

The centrifuge tube is shaken with a shaker at 350 spm (strokes per min) for 20 min. After shaking, the solution is transferred into a glass tube for a swing rotor (50 mL) and separated by a centrifuge at 3500 rpm for 30 min. By this operation, the toner particles are separated from the detached external additive. It is visually confirmed that the toner and the aqueous solution are sufficiently separated, and the toner separated in the uppermost layer is collected with a spatula or the like. The collected toner is filtered with a vacuum filter and then dried with a dryer for 1 h or longer to obtain toner particles. This operation is performed multiple times to ensure the required amount.

Measurement of Amount of Polyvalent Metal Element by X-ray Photoelectron Spectroscopy The amount of the polyvalent element is calculated by performing surface composition analysis by X-ray photoelectron spectroscopy (ESCA).

In the present invention, the ESCA apparatus and measurement conditions are as follows.

Sample preparation is performed in the following manner. As a sample holder, a 75 mm square platen (provided with a screw hole having a diameter of about 1 mm for fixing the sample) attached to the apparatus is used. Since the screw hole of the platen passes through, the hole is closed with a resin or the like, and a recess for powder measurement having a depth of about 0.5 mm is produced. The measurement sample (toner particles) is packed in the recess with a spatula or the like, and the sample is prepared by cutting by rubbing.

Apparatus Used:

Quantum 2000 Scanning ESCA Microprobe manufactured by PHI (Physical Electronics Industries, Inc.)

Measurement Conditions:

Excitation X-ray: Al Kα
Photoelectron escape angle: 45°
X-ray: 100 μm, 25 W, 15 kV
Raster: 300 μm×200 μm
Electron neutralizing gun: 20 μA, 1 V
Ion neutralizing gun: 7 mA, 10 V
Pass Energy: 58.70 eV
Step Size: 0.125 eV From the peak intensity of each element measured under the above conditions, the surface atomic concentration (atomic %) is calculated using the relative sensitivity factor provided by PHI, and the mass concentration of the polyvalent metal element is calculated using the atomic weight.

EXAMPLES

Hereinafter, the present invention will be described in greater detail based on examples, but the present invention is not limited thereto. In addition, unless otherwise indicated, the number of parts in the following blending relates to parts by mass.

First, the methods for the evaluation performed in the examples will be described below.

(1) Evaluation of Low-Temperature Fixability and Hot Offset Resistance

The toner and a ferrite carrier surface-coated with a silicone resin (average particle diameter 42 μm) were mixed to a toner concentration of 6% by mass to prepare a two-component developer. A commercially available full-color digital copying machine (trade name: CLC700, manufactured by Canon Inc.) was used, and an unfixed toner image (1.2 mg/cm$^2$) was formed on image-receiving paper (80 g/m$^2$).

A fixing unit removed from a commercially available full-color digital copying machine (trade name: CLC700, manufactured by Canon Inc.) was modified so that the fixing temperature could be adjusted, and a fixing test of the unfixed image was performed using the fixing unit. Under normal temperature and humidity, the process speed was set to 200 mmisec, and the toner image was fixed at each temperature while changing the set temperature by 5° C. within the range of from 110° C. to 250° C. The obtained fixed image was reciprocatingly rubbed five times with sylbon paper to which a load of 4.9 kPa was applied, and the temperature at which the density reduction ratio between before and after the rubbing was 10% or less was defined as the low-temperature fixing start temperature. The lower this temperature, the better the low-temperature fixability. Less than 160° C. was determined to be satisfactory.

Regarding the image density, the reflection density for a printout image of a white background portion having a document density of 0.00 was measured using "Macbeth Reflection Densitometer RD918" (manufactured by Macbeth Co.).

Further, the obtained image was visually observed, and the temperature on the high temperature side where the offset began to occur was defined as the hot offset occurrence temperature. It was determined that 170° C. or higher was satisfactory.

(2) Evaluation of Fixed Image Gloss

A solid image (toner laid-on level: 0.6 mg/cm$^2$) was outputted at a fixing temperature of 180° C., and the gloss value was measured using PG-3D (manufactured by Nippon Denshoku Industries Co., Ltd.). As the transfer material, LETTER size plain paper (XEROX 4200 paper, manufactured by XEROX, 75 g/m$^2$) was used. C or higher was determined to be satisfactory.

Evaluation Criteria

A: gloss value is 50 or more.

B: gloss value is 40 or more and less than 50.

C: gloss value is 20 or more and less than 40.

D: gloss value is less than 20.

(3) Evaluation of Fixed Image Mottling

OCE RED LABEL (basis weight: 80 g/m$^2$), which is rough paper, was used as evaluation paper. Solid images with a print percentage of 100% were continuously passed on one side by 100 prints for each evaluation paper. Mottling of the obtained image was visually checked and determined by the following indexes. "Mottle", as referred to herein, is a kind of poorly fixed image, in which the melt viscosity of the toner image is too low and the paper streaks appear to give a rough image. C or higher was determined to be satisfactory.

A: no mottle occurrence site is present on any of 100 prints.

B: mottle occurrence sites are present on 1 to 3 out of 100 prints.

C: mottle occurrence sites are present on 4 to 9 out of 100 prints.

D: mottle occurrence sites are present on 10 or more out of 100 prints.

(4) Evaluation of Heat-Resistant Storage Stability/Blocking Resistance

Approximately 10 g of the toner was put in a 100 mL resin cup and allowed to stand in an environment of temperature 45° C. and humidity 95% for 7 days, followed by visual evaluation. C or higher was determined to be satisfactory.

Evaluation Criteria

A: aggregates are not seen.

B: although aggregates are seen, they collapse easily.

C: aggregates are seen, but collapse if shaken.

D: aggregates can be grasped and do not collapse easily.

(5) Image Durability Test after Allowing the Toner to Stand in High-Temperature and High-Humidity Environment A toner allowed to stand overnight in a high-temperature and high-humidity environment (30° C., 80%) and a ferrite carrier (average particle diameter 42 μm) surface-coated with a silicone resin were mixed so that the toner concentration was 6% by mass, and a two-component developer was prepared. Using a commercially available full-color digital copying machine (trade name: CLC700, manufactured by Canon Inc.), a print test of 15000 prints was performed in an environment of 32.5° C. and 80% humidity. After completion of the 15000-print test, a solid image was outputted, and the density of the solid image was measured at 10 points by the same method as in (1) to evaluate the density difference between the highest density and the lowest density in the plane. When the toner is damaged in a high-temperature and high-humidity environment, the movement in the cartridge becomes poor and density unevenness occurs. Ranking was performed as follows. C or higher was determined to be satisfactory.

A: density difference is less than 0.05.

B: density difference is 0.05 or more and less than 0.10.

C: density difference is 0.10 or more and less than 0.20.

D: density difference is 0.20 or more.

Production Example 1 of Diester Compound

A total of 312.9 parts of stearic acid and 31 parts of ethylene glycol were added to a four-necked flask equipped with a thermometer, a nitrogen introducing tube, a stirrer and a cooling tube, and a reaction was conducted for 15 hours at normal pressure while distilling off the reaction water at 180° C. under a nitrogen stream. To 100 parts of the esterified crude product obtained by this reaction, 20 parts of toluene and 4 parts of ethanol were added. Furthermore, a 10% potassium hydroxide aqueous solution including potassium hydroxide in an amount corresponding to 1.5 times equivalent of the acid value of the crude esterified product was added followed by stirring at 70° C. for 30 min.

After stirring, the mixture was allowed to stand for 30 min, and then the esterified crude product was washed with water by removing the aqueous phase (lower layer) separated from the ester phase. The washing with water was repeated four times until the pH of the aqueous phase reached 7. Thereafter, the solvent was distilled off from the ester phase, which was washed with water, under reduced pressure conditions of 180° C. and 1 kPa, followed by filtration to obtain a diester compound (1A) (ethylene glycol distearate). The crystallization temperature of the diester compound (1A) was 65° C.

Production Example 2 of Diester Compound

A diester compound (2A) (distearyl succinate) was obtained in the same manner as in Production Example 1, except that in Production Example 1 of Diester Compound, 312.9 parts of stearic acid was changed to 118.1 parts of succinic acid, and 31 parts of ethylene glycol was changed to 148.7 parts of stearyl alcohol. The crystallization temperature of the diester compound (2A) was 65° C.

Example 1

Preparation of Binder Resin Particle-Dispersed Solution

A total of 89.5 parts of styrene, 9.2 parts of butyl acrylate, 1.3 parts of acrylic acid as a monomer providing a carboxy group, and 3.2 parts of n-lauryl mercaptan were mixed and dissolved. To the solution obtained, an aqueous solution in which 1.5 parts of NEOGEN RK (Daiichi Kogyo Seiyaku Co., Ltd.) was dissolved in 150 parts of ion exchanged water was added and dispersed.

Further, an aqueous solution in which 0.3 parts of potassium persulfate was dissolved in 10 parts of ion exchanged water was added while stirring slowly for 10 min. After nitrogen substitution, emulsion polymerization was performed at 70° C. for 6 h. After completion of the polymerization, the reaction solution was cooled to room temperature, and ion exchange water was added to obtain a resin particle-dispersed solution having a solid fraction concentration of 12.5% by mass and a volume-based median diameter of 0.2 μm.

The resin constituting the resin particles had a carboxy group derived from acrylic acid. The glass transition temperature of the binder resin was 60° C.

Preparation of Wax-Dispersed Solution

A total of 100 parts of the diester compound (1A), 30 parts of paraffin wax "HNP-9" (manufactured by Nippon Seiwa Co., Ltd., melting point: 75° C.) as release wax, and 20 parts of NEOGEN RK were mixed with 400 parts of ion exchanged water. The mixture was then dispersed for about 1 h using a wet jet mill JN100 (manufactured by JOKOH) to obtain a wax-dispersed solution.

Preparation of Colorant-Dispersed Solution

A total of 100 parts of carbon black "Nipex 35 (manufactured by Orion Engineered Carbons)" as a colorant and 15 parts of NEOGEN RK were mixed with 885 parts of ion exchanged water and dispersed using a wet jet mill JN 100 for about 1 h to obtain a colorant-dispersed solution.

Production Example of Toner Particles 1

A total of 265 parts of the resin particle-dispersed solution, 80 parts of the wax-dispersed solution and 10 parts of the colorant-dispersed solution were dispersed using a homogenizer (ULTRA TURRAX T50, manufactured by IKA Works, Inc.). The temperature inside the vessel was adjusted to 30° C. under stirring, and 1 mol/L sodium hydroxide aqueous solution was added to adjust the pH to 8.0.

As a flocculant, an aqueous solution prepared by dissolving 0.05 parts of aluminum chloride in 10 parts of ion exchanged water was added over 10 min under stirring at 30° C. Raise in temperature was started after allowing to stand for 3 min, and the temperature was raised to 50° C. to generate coalesced particles. In that state, the particle diameter of coalesced particles was measured with "Coulter Counter Multisizer 3" (registered trademark, manufactured by Beckman Coulter, Inc.). When the weight average particle diameter reached 6.5 μm, 3.0 parts of sodium chloride and 8.0 parts of NEOGEN RK were added to stop the particle growth.

Here, 0.10 parts of aluminum chloride was added as an additional metal compound, and the temperature was raised to 95° C. By stirring and holding at 95° C., the coalesced particles were fused and spheroidized. When the average circularity reached 0.980, cooling was performed to 80° C., followed by holding as is at 80° C. By adding ice water, rapid cooling was performed from a rapid cooling start temperature of 80° C. to a rapid cooling end temperature of 30° C. at a rapid cooling rate of 3° C./sec to obtain a toner particle-dispersed solution 1.

Hydrochloric acid was added to the resultant toner particle-dispersed solution 1 to adjust the pH to 1.5 or less, and after allowing to stand under stirring for 1 h, solid-liquid separation was performed by a pressure filter to obtain a toner cake. This was reslurried with ion exchanged water to prepare a dispersion again, followed by solid-liquid separation with the aforementioned filter. The reslurrying and solid-liquid separation were repeated until the electric conductivity of the filtrate became 5.0 μS/cm or less, and then solid-liquid separation was performed to obtain a toner cake.

The resulting toner cake was dried with an air flow dryer FLASH JET DRYER (manufactured by Seishin Enterprise Co., Ltd.). The drying conditions were adjusted to a blowing temperature of 80° C. and a dryer outlet temperature of 37° C., and the toner cake feeding speed was adjusted according to the moisture content of the toner cake to a speed at which the outlet temperature did not deviate from 37° C.

Further, the fine and coarse powders were cut using a multi-division classifier utilizing the Coanda effect to obtain toner particles 1. To 100.0 parts of the obtained toner particles, 1.0 part of silica fine particles having a number average particle diameter of primary particles of 40 nm was added and mixed using an FM mixer (manufactured by Nippon Coke Industries) to obtain a toner 1. Table 2 shows the physical properties of the obtained toner, and Table 3 shows the results of each evaluation.

Examples 2 to 4

Toners 2 to 4 were produced in the same manner as in the production example of toner 1 except that the rapid cooling start temperature, rapid cooling end temperature, and rapid cooling rate after spheroidization were changed as shown in Table 1. Table 2 shows the physical properties, and Table 3 shows the results of each evaluation.

Examples 5 to 7, 9 to 26

Toners 5 to 7 and toners 9 to 26 were prepared in the same manner as in the production example of toner 1 except that the type and amount of flocculant to be added and the type and amount of additional metal compound were changed as shown in Table 1. Table 2 shows the physical properties, and Table 3 shows the results of each evaluation.

Example 8

Toner 8 was prepared in the same manner as in the production example of toner 1 except that the monomers to be mixed in the preparation of the binder resin particle-dispersed solution were styrene (90.8 parts) and butyl acrylate (9.2 parts), and the carboxy group-providing monomer was not mixed. Table 2 shows the physical properties of the toner 8, and Table 3 shows the results of each evaluation.

Example 27

Toner 27 was prepared in the same manner as in the production example of toner 1 except that the diester compound (1A) added in the preparation of the wax-dispersed solution was changed to the diester compound (2A). Table 2 shows the analysis result of the toner 27, and Table 3 shows the results of each evaluation.

Comparative Example 1

Comparative toner 1 was prepared in the same manner as in the production example of toner 1 except that the diester compound (1A) was not added in the preparation of the wax-dispersed solution. Table 2 shows the analysis result of the comparative toner 1, and Table 3 shows the results of each evaluation.

Comparative Examples 2 to 4

Comparative toners 2 to 4 were prepared in the same manner as in the preparation example of toner 1 except that the rapid cooling start temperature, the rapid cooling end temperature, and the rapid cooling rate after spheroidization were changed as shown in Table 1. Table 2 shows the physical properties of comparative toners 2 to 4, and Table 3 shows the results of each evaluation.

Comparative Examples 5 to 7

Comparative toners 5 to 7 were prepared in the same manner as in the preparation example of toner 1 except that the type and amount of the flocculant to be added and the type and amount of additional metal compound were changed as shown in Table 1. Table 2 shows the physical properties of comparative toners 5 to 7, and Table 3 shows the results of each evaluation.

Comparative Example 8

The type and amount of flocculant to be added were changed as shown in Table 1. Further, aluminum salicylate (trade name: BONTRON E88, manufactured by Orient Chemical Industries Co., Ltd.), which is a charge control agent, was added as an additional metal compound. Other than that, a comparative toner 8 was produced in the same manner as in the preparation example of toner 1. Table 2 shows the physical properties of comparative toner 8 and Table 3 shows the results of each evaluation.

Comparative Example 9

A total of 75 parts of styrene and 25 parts of n-butyl acrylate as monovinyl monomers, 7 parts of carbon black (trade name "#25B" manufactured by Mitsubishi Chemical Corporation) as a black colorant, 0.60 parts of divinylbenzene as a crosslinkable polymerizable monomer, 1.0 part of t-dodecyl mercaptan as a molecular weight modifier, and 0.25 part of polymethacrylate macromonomer (trade name "AA6", manufactured by Toa Gosei Co., Ltd.) as a macromonomer were wet pulverized using a media type wet pulverizing machine. Thereafter, 10 parts of the diester compound (1A) was mixed to obtain a polymerizable monomer composition.

Meanwhile, a magnesium hydroxide colloid dispersion (magnesium hydroxide 3.0 parts) was prepared by gradually adding, under stirring in an agitation tank at room temperature, an aqueous solution in which 4.1 parts of sodium hydroxide was dissolved in 50 parts of ion exchanged water to an aqueous solution in which 7.4 parts of magnesium chloride was dissolved in 250 parts of ion exchanged water.

The polymerizable monomer composition was fed at 25° C. to the magnesium hydroxide colloidal dispersion obtained as described above, and stirred until the droplets were stabilized. A total of 5 parts of t-butylperoxy-2-ethylhexanoate (trade name "PERBUTYL O", manufactured by NOF Corporation) was then added as a polymerization initiator, and droplets of the polymerizable monomer composition were thereafter formed by high-shear stirring at a rotational speed of 15,000 rpm by using an in-line type emulsifying disperser (trade name "EBARA MILDER", manufactured by Ebara Corporation).

A suspension (polymerizable monomer composition-dispersed solution) in which droplets of the polymerizable monomer composition obtained as described above were dispersed was fed into a reactor equipped with a stirring blade and heated to 90° C. to initiate the polymerization reaction. When the polymerization conversion ratio reached almost 100%, 1.5 parts of methyl methacrylate (polymerizable monomer for a shell) and 0.15 parts of 2,2'-azobis(2-methyl-N-(2-hydroxyethyl)-propionamide) (polymerization initiator for a shell, manufactured by Wako Pure Chemical Industries, Ltd., trade name "VA-086", water-soluble) dissolved in 20 parts of ion exchanged water were added in the reactor. Thereafter, the polymerization was continued for 3 h by maintaining the temperature at 90° C., and the reaction was then stopped by cooling with water, whereby a comparative toner particle-dispersed solution 9 was obtained.

Then, hydrochloric acid was added to the obtained comparative toner particle-dispersed solution 9 to adjust the pH to 1.5 or lower, and the mixture was further stirred for 1 h, followed by solid-liquid separation with a pressure filter to obtain a toner cake. The cake was reslurried with ion exchanged water to obtain a dispersion again, followed by solid-liquid separation with the aforementioned filter. Reslurrying and solid-liquid separation were repeated until the filtrate had an electric conductivity of 5.0 μS/cm or less, and then solid-liquid separation was performed to obtain a toner cake.

The obtained toner cake was dried with an air flow dryer FLASH JET DRYER (manufactured by Seishin Enterprise Co., Ltd.). The drying conditions were adjusted to a blowing temperature of 80° C. and a dryer outlet temperature of 37° C., and the toner cake feeding speed was adjusted according to the moisture content of the toner cake to a speed at which the outlet temperature did not deviate from 37° C.

Further, the fine and coarse powders were cut using a multi-division classifier utilizing the Coanda effect to obtain comparative toner particles 9. To 100.0 parts of the obtained toner particles, 1.0 part of silica fine particles having a number average particle diameter of primary particles of 40 nm was added and mixed using an FM mixer (manufactured by Nippon Coke Industries) to obtain a comparative toner 9. Table 2 shows the physical properties of the obtained toner, and Table 3 shows the results of each evaluation.

TABLE 1

| Example | Flocculant | | Additional metal compound | | Rapid cooling start temperature | Rapid cooling end temperature | Rapid cooling rate |
|---|---|---|---|---|---|---|---|
| No. | Type | Parts | Type | Parts | (° C.) | (° C.) | (° C./sec) |
| 1 | Aluminum chloride | 0.05 | Aluminum chloride | 0.10 | 80 | 30 | 3 |
| 2 | Aluminum chloride | 0.05 | Aluminum chloride | 0.10 | 80 | 50 | 3 |

TABLE 1-continued

| Example No. | Flocculant Type | Flocculant Parts | Additional metal compound Type | Additional metal compound Parts | Rapid cooling start temperature (° C.) | Rapid cooling end temperature (° C.) | Rapid cooling rate (° C./sec) |
|---|---|---|---|---|---|---|---|
| 3 | Aluminum chloride | 0.05 | Aluminum chloride | 0.10 | 80 | 30 | 0.5 |
| 4 | Aluminum chloride | 0.05 | Aluminum chloride | 0.10 | 80 | 30 | 10 |
| 5 | Aluminum chloride | 0.02 | Not added | | 80 | 30 | 3 |
| 6 | Aluminum chloride | 0.10 | Aluminum chloride | 0.20 | 80 | 30 | 3 |
| 7 | Aluminum chloride | 0.02 | Aluminum chloride | 0.10 | 80 | 30 | 3 |
| 8 | Aluminum chloride | 0.05 | Aluminum chloride | 0.10 | 80 | 30 | 3 |
| 9 | Iron (III) chloride | 0.05 | Iron (III) chloride | 0.10 | 80 | 30 | 3 |
| 10 | Copper (II) chloride | 0.30 | Copper (II) chloride | 0.50 | 80 | 30 | 3 |
| 11 | Zinc chloride | 0.30 | Zinc chloride | 0.50 | 80 | 30 | 3 |
| 12 | Magnesium chloride | 0.30 | Magnesium chloride | 0.50 | 80 | 30 | 3 |
| 13 | Calcium chloride | 0.30 | Calcium chloride | 0.50 | 80 | 30 | 3 |
| 14 | Cobalt (II) chloride | 0.30 | Cobalt (II) chloride | 0.50 | 80 | 30 | 3 |
| 15 | Aluminum chloride | 0.03 | Not added | | 80 | 30 | 3 |
| 16 | Aluminum chloride | 0.05 | Not added | | 80 | 30 | 3 |
| 17 | Aluminum chloride | 0.05 | Aluminum chloride | 0.20 | 80 | 30 | 3 |
| 18 | Aluminum chloride | 0.08 | Aluminum chloride | 0.20 | 80 | 30 | 3 |
| 19 | Iron (III) chloride | 0.03 | Not added | | 80 | 30 | 3 |
| 20 | Iron (III) chloride | 0.05 | Not added | | 80 | 30 | 3 |
| 21 | Iron (III) chloride | 0.05 | Iron (III) chloride | 0.20 | 80 | 30 | 3 |
| 22 | Iron (III) chloride | 0.08 | Iron (III) chloride | 0.20 | 80 | 30 | 3 |
| 23 | Magnesium chloride | 0.30 | Not added | | 80 | 30 | 3 |
| 24 | Magnesium chloride | 0.50 | Not added | | 80 | 30 | 3 |
| 25 | Magnesium chloride | 0.50 | Magnesium chloride | 0.70 | 80 | 30 | 3 |
| 26 | Magnesium chloride | 0.70 | Magnesium chloride | 0.70 | 80 | 30 | 3 |
| 27 | Aluminum chloride | 0.05 | Aluminum chloride | 0.10 | 80 | 30 | 3 |
| C.E. 1 | Aluminum chloride | 0.05 | Aluminum chloride | 0.10 | 80 | 30 | 3 |
| C.E. 2 | Aluminum chloride | 0.05 | Aluminum chloride | 0.10 | 80 | 70 | 3 |
| C.E. 3 | Aluminum chloride | 0.05 | Aluminum chloride | 0.10 | 80 | 30 | 0.1 |
| C.E. 4 | Aluminum chloride | 0.05 | Aluminum chloride | 0.10 | 80 | 30 | 15 |
| C.E. 5 | Aluminum chloride | 0.01 | Not added | | 80 | 30 | 3 |
| C.E. 6 | Aluminum chloride | 0.15 | Aluminum chloride | 0.30 | 80 | 30 | 3 |
| C.E. 7 | Aluminum chloride | 0.05 | Aluminum chloride | 0.70 | 80 | 30 | 3 |
| C.E. 8 | Aluminum chloride | 0.05 | Charge control agent Aluminum salicylate | 0.10 | 80 | 30 | 3 |

In the Tables, "C.E." denotes "comparative example".

TABLE 2

| Example No. | As (%) | Average number of wax domains (domains) | Polyvalent metal element detected by fluorescent X-rays | Mi (ppm) | Net intensity | Polyvalent metal element detected by X-ray photoelectron spectroscopy | Ms (ppm) |
|---|---|---|---|---|---|---|---|
| 1 | 10.0 | 500 | Aluminum | 500.0 | 0.3 | Aluminum | 50.0 |
| 2 | 13.0 | 500 | Aluminum | 500.0 | 0.3 | Aluminum | 50.0 |
| 3 | 10.0 | 15 | Aluminum | 500.0 | 0.3 | Aluminum | 50.0 |
| 4 | 10.0 | 1900 | Aluminum | 500.0 | 0.3 | Aluminum | 50.0 |
| 5 | 10.0 | 500 | Aluminum | 4.0 | 0.0 | Aluminum | 2.0 |
| 6 | 10.0 | 500 | Aluminum | 1000.0 | 0.6 | Aluminum | 200.0 |
| 7 | 10.0 | 500 | Aluminum | 200.0 | 0.1 | Aluminum | 190.0 |
| 8 | 10.0 | 500 | Aluminum | 500.0 | 0.3 | Aluminum | 50.0 |
| 9 | 10.0 | 500 | Iron | 500.0 | 3.0 | Iron | 50.0 |
| 10 | 10.0 | 500 | Copper | 500.0 | — | Copper | 50.0 |
| 11 | 10.0 | 500 | Zinc | 500.0 | — | Zinc | 50.0 |
| 12 | 10.0 | 500 | Magnesium | 500.0 | 10.0 | Magnesium | 50.0 |
| 13 | 10.0 | 500 | Calcium | 500.0 | 10.0 | Calcium | 50.0 |
| 14 | 10.0 | 500 | Cobalt | 500.0 | — | Cobalt | 50.0 |
| 15 | 10.0 | 500 | Aluminum | 83.0 | 0.1 | Aluminum | 15.0 |
| 16 | 10.0 | 500 | Aluminum | 250.0 | 0.2 | Aluminum | 30.0 |
| 17 | 10.0 | 500 | Aluminum | 750.0 | 0.5 | Aluminum | 90.0 |
| 18 | 10.0 | 500 | Aluminum | 917.0 | 0.6 | Aluminum | 110.0 |
| 19 | 10.0 | 500 | Iron | 50.0 | 0.5 | Iron | 13.0 |
| 20 | 10.0 | 500 | Iron | 150.0 | 1.5 | Iron | 20.0 |
| 21 | 10.0 | 500 | Iron | 450.0 | 4.5 | Iron | 46.0 |
| 22 | 10.0 | 500 | Iron | 550.0 | 5.5 | Iron | 57.0 |
| 23 | 10.0 | 500 | Magnesium | 50.0 | 2.5 | Magnesium | 13.0 |
| 24 | 10.0 | 500 | Magnesium | 150.0 | 3.5 | Magnesium | 20.0 |
| 25 | 10.0 | 500 | Magnesium | 450.0 | 19.5 | Magnesium | 46.0 |
| 26 | 10.0 | 500 | Magnesium | 550.0 | 20.5 | Magnesium | 57.0 |
| 27 | 10.0 | 500 | Aluminum | 500.0 | 0.3 | Aluminum | 50.0 |
| C.E. 1 | 0 | 1 | Aluminum | 500.0 | 0.3 | Aluminum | 50.0 |

TABLE 2-continued

| Example No. | As (%) | Average number of wax domains (domains) | Polyvalent metal element detected by fluorescent X-rays | Mi (ppm) | Net intensity | Polyvalent metal element detected by X-ray photoelectron spectroscopy | Ms (ppm) |
|---|---|---|---|---|---|---|---|
| C.E. 2 | 18.0 | 500 | Aluminum | 500.0 | 0.3 | Aluminum | 50.0 |
| C.E. 3 | 10.0 | 7 | Aluminum | 500.0 | 0.3 | Aluminum | 50.0 |
| C.E. 4 | 10.0 | 2100 | Aluminum | 500.0 | 0.3 | Aluminum | 50.0 |
| C.E. 5 | 10.0 | 500 | Aluminum | 3.0 | 0.0 | Aluminum | 1.5 |
| C.E. 6 | 10.0 | 500 | Aluminum | 1200.0 | 0.7 | Aluminum | 250.0 |
| C.E. 7 | 10.0 | 500 | Aluminum | 200.0 | 0.1 | Aluminum | 230.0 |
| C.E. 8 | 10.0 | 500 | Aluminum | 200.0 | 0.1 | Aluminum | 500.0 |
| C.E. 9 | 10.0 | 500 | — | 0.0 | 0.0 | Magnesium | 0.0 |

TABLE 3

| Example No. | Low-temperature fixability (° C.) | Hot offset (° C.) | Gloss of fixed image | Mottling of fixed image | Heat-resistant storage stability | Development durability |
|---|---|---|---|---|---|---|
| 1 | 130 | 200 | A (50) | B (2) | A | A (0.02) |
| 2 | 140 | 200 | A (50) | B (2) | B | B (0.08) |
| 3 | 150 | 180 | A (50) | C (4) | A | A (0.02) |
| 4 | 115 | 200 | A (50) | B (2) | C | C (0.15) |
| 5 | 120 | 170 | A (60) | C (6) | C | C (0.15) |
| 6 | 140 | 220 | C (30) | A (0) | A | A (0.00) |
| 7 | 125 | 185 | B (45) | C (4) | B | B (0.05) |
| 8 | 140 | 180 | A (50) | C (4) | A | A (0.02) |
| 9 | 130 | 200 | A (50) | B (2) | A | A (0.02) |
| 10 | 130 | 200 | A (50) | B (2) | A | A (0.02) |
| 11 | 130 | 200 | A (50) | B (2) | A | A (0.02) |
| 12 | 130 | 200 | A (50) | B (2) | A | A (0.02) |
| 13 | 130 | 200 | A (50) | B (2) | A | A (0.02) |
| 14 | 130 | 180 | A (50) | C (4) | A | A (0.02) |
| 15 | 125 | 165 | A (55) | C (5) | B | B (0.05) |
| 16 | 125 | 195 | A (50) | B (3) | A | A (0.02) |
| 17 | 135 | 210 | B (45) | B (1) | A | A (0.02) |
| 18 | 140 | 220 | B (40) | A (0) | A | A (0.02) |
| 19 | 120 | 160 | A (55) | C (5) | B | B (0.05) |
| 20 | 125 | 195 | A (50) | B (3) | A | A (0.02) |
| 21 | 125 | 205 | B (45) | B (1) | A | A (0.02) |
| 22 | 130 | 210 | B (40) | A (0) | A | A (0.02) |
| 23 | 120 | 160 | A (55) | C (5) | B | B (0.05) |
| 24 | 125 | 195 | A (50) | B (3) | A | A (0.02) |
| 25 | 125 | 205 | B (45) | B (1) | A | A (0.02) |
| 26 | 130 | 210 | B (40) | A (0) | A | A (0.02) |
| 27 | 130 | 200 | A (50) | B (2) | A | A (0.02) |
| C.E. 1 | 180 | 200 | D (15) | A (0) | A | A (0.00) |
| C.E. 2 | 160 | 230 | A (50) | B (2) | D | D (0.25) |
| C.E. 3 | 160 | 175 | C (30) | B (1) | A | A (0.02) |
| C.E. 4 | 115 | 210 | A (55) | C (4) | D | D (0.25) |
| C.E. 5 | 130 | 150 | A (55) | D (12) | D | D (0.30) |
| C.E. 6 | 160 | 240 | D (15) | A (0) | A | A (0.00) |
| C.E. 7 | 125 | 155 | A (60) | D (15) | D | D (0.30) |
| C.E. 8 | 125 | 155 | A (60) | D (15) | D | D (0.30) |
| C.E. 9 | 125 | 150 | A (60) | D (15) | D | D (0.30) |

As is apparent from Tables 2 and 3, according to the present invention, it is possible to provide a toner that ensures excellent image quality such as gloss and resistance to mottling of a fixed image while achieving both low-temperature fixability and hot offset resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-209766, filed Nov. 7, 2018, which is hereby incorporated by reference herein in its entirety.

What is claimed is:

1. A toner comprising a toner particle including a binder resin and a wax, wherein the wax includes at least one selected from the group consisting of diester compounds represented by following formulas (1) and (2);

when a proportion of an area occupied by the wax in a region from a surface of the toner particle to 0.5 μm in cross-sectional observation of the toner using a transmission electron microscope is denoted by As, As is 15.0% or less;

wax domains are observed in the cross section of the toner particle in cross-sectional observation of the toner using a transmission electron microscope, and an average number of the domains per cross section of one toner particle is from 10 to 2000;

when a mass concentration of a polyvalent metal element in the toner particle determined by fluorescent X-ray analysis is denoted by Mi (ppm), Mi is from 3.5 ppm to 1100 ppm; and when a mass concentration of a polyvalent metal element in the toner particle determined by X-ray photoelectron spectroscopy is denoted by Ms (ppm), the following expression:

$$Mi > Ms$$

is satisfied;

(1)

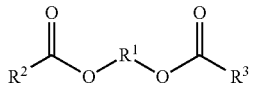

(2)

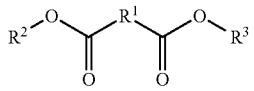

in the formulas (1) and (2), $R^1$ represents an alkylene group having from 1 to 6 carbon atoms, and $R^2$ and $R^3$ each independently represent a linear alkyl group having from 11 to 25 carbon atoms.

2. The toner according to claim 1, wherein the binder resin has a carboxy group; and the polyvalent metal element is at least one selected from the group consisting of iron, aluminum, copper, zinc, magnesium, and calcium.

3. The toner according to claim 2, wherein the polyvalent metal element is aluminum, and a Net intensity based on the aluminum measured by fluorescent X-ray analysis is from 0.10 kcps to 0.50 kcps.

4. The toner according to claim 2, wherein the polyvalent metal element is iron, and a Net intensity based on the iron measured by fluorescent X-ray analysis is from 1.00 kcps to 5.00 kcps.

5. The toner according to claim 2, wherein the polyvalent metal element is magnesium or calcium, and a Net intensity based on the magnesium or calcium measured by fluorescent X-ray analysis is from 3.00 kcps to 20.00 kcps.

* * * * *